United States Patent [19]

Goldman

[11] 4,442,670

[45] Apr. 17, 1984

[54] CLOSED-CYCLE HEAT-ENGINE

[76] Inventor: Jacob Goldman, 11/6 Biram St., Haifa, Israel

[21] Appl. No.: 397,410

[22] Filed: Jul. 12, 1982

[51] Int. Cl.[3] ..... F02G 1/04

[52] U.S. Cl. ..... 60/517; 60/508; 60/516

[58] Field of Search ..... 60/516, 517, 508–515, 60/530, 531

[56] References Cited

U.S. PATENT DOCUMENTS 4,270,351 6/1981 Kuhns ..... 60/508 X 4,356,697 11/1982 White ..... 60/516 X

*Primary Examiner*—Allen M. Ostrager

*Attorney, Agent, or Firm*—Schwartz, Jeffery, Schwaab, Mack, Blumenthal & Koch

[57] ABSTRACT

A closed-cycle heat engine consists of a gas-filled heat-insulated cylinder and a reciprocating piston. The cylinder space between the cylinder head and the piston face contains a spiral in the shape of flat interconnected discs, whereof the outermost disc at each end is heat-conductively attached to the cylinder head and the piston face respectively. About 10% of the discs at both ends of the spiral are of high heat-conductive material and about 80% of the discs inbetween are of a low heat-conductive sheet material. The cylinder head is permanently heated to a high temperature, and the piston is permanently cooled to a low temperature; the gas in the cylinder is alternately cooled and heated by the shifting movement of the discs, which are alternately closely packed adjacent the piston at the end of the compression stroke, and adjacent the cylinder head at the end of the expansion stroke. This shifting between the end positions is performed by an alternately directed gas stream.

18 Claims, 5 Drawing Figures

CLOSED-CYCLE HEAT-ENGINE

BACKGROUND OF THE INVENTION

The invention relates to a closed-cycle heat-engine of the kind known as a Stirling engine, adapted to convert heat supplied by a high-temperature source and rejected at a low-temperature sink, into mechanical energy by alternately compressing and expanding a gas and alternately heating and cooling it. The engine cycle may be reversed and the system is adaptable for refrigerating and heat pumping purposes. The known Stirling engines are being built to various lay-outs, all being characterized by that they comprise a working piston and a displacer piston reciprocatingly moving in two cylinders, th cylinders communicating through a regenerator which acts as a thermal storage device and alternately heats and cools the gas passing therethrough. All engines comprise a heater and a cooler which are separated by the said regenerator and are adapted to respectively heat and cool the gas while it is in contact with their heat-exchange surfaces.

In some Stirling engines the two cylinders are coaxial, i.e. they are in the form of a single, long cylinder, where a working and a displacing piston each are movable in approximation of the theoretical requirements of the Stirling cycle.

The ideal Stirling cycle comprises the following steps:

1. The gas is isothermally compressed in a "cold space".
2. After compression the gas is transferred by the displacement piston to a "hot space", via the regenerator which heats it, at constant volume, to the temperature of the "hot space".
3. The hot gas wholly contained in the "hot space" expands isothermally, by simultaneous movement of both the working and the displacementpistons.
4. The gas is transferred to the "cold space" via the regenerator which cools it, at constant volume, to the temperature of the "cold space".

The actual cycle differs from the ideal cycle in many respects for the following reasons:

1. Isothermal compression and expansion cannot be achieved during the rapid movement of the pistons.
2. The regenerator volume is not zero, and the expansion and compression of the gas in this space results in a reduction in the specific output.
3. Various drive mechanisms have been designed with the aim to move the pistons in a discontinuous motion allowing for the ideal cycle to prevail; however, since the mechanisms comprises gears, crankshafts and levers only sinusoidal approximation can be attained, whereby the ideal pressure/-volume diagram is distorated.

The result is that the engine efficiency is too low to make it competitive with other heat engines, also because the drive mechanism is complicated and, accordingly, expensive.

SUMMARY OF THE INVENTION

It is, therefore, the object of the present invention to provide a heat engine of the Stirling design, wherein the ideal cycle is better approximated than in the existing engines, and wherein the compression and expansion strokes are under substantially isothermal conditions. It is a further object to provide a heat engine which can be used as a prime mover, but likewise in a refrigeration or heat pump cycle, by making the heat transfer process during steps 2 and 4 of the ideal cycle reversible and by obtaining virtually isothermic compression and expansion during steps 1 and 3. Still another object is to provide a low-priced engine of relatively high efficiency which should thus be competitive with other engines.

The heat engine, according to the present invention, comprises a gas-filled cylinder and a piston reciprocating therein. The cylinder walls are heat-insulated, and the cylinder head, remote from the piston, is adapted to be permanently heated by a fluid in contact with the heat source. The piston is similarly cooled by a fluid at low temperature in contact with a sink, means being provided for supplying and removing this fluid during the reciprocating motion of the piston. In the following description it will be assumed that the cylinder head is permanently heated and the piston permanently cooled, but it will be understood that the heat source and sink may be reversed, in order to cool the cylinder and to heat the piston.

The cylinder space between the piston and the cylinder head contains an expansible and contractible chain of interconnected, parallel-positioned, flat discs of a thin sheet material of a diameter slightly smaller than the cylinder diameter, which are adapted to be shifted alternately into closely-packed and spaced-apart relationship. The outermost disc at each end of the chain of discs is firmly and heat-conductively connected to the—preferably flat—piston top and to the—preferably flat—inside of the cylinder head respectively. A portion of the discs at the end attached to the cylinder head, hereinafter denominated the "heater" portion, and similarly a portion of the discs at the end attached to the piston top, hereinafter denominated the "cooler" portion, are of a highly heat-conducting material, such as copper, their surfaces being flat and smooth and each portion comprising about 10% of all discs, while the remaining 80% positioned between the end portions are of a material of low heat-conductivity, serving as regenerator. The chain of discs, during working of the engine, is essentially in two alternative positions: a first position wherein the majority of the discs is in closely-packed state adjoining the piston top, while the "heater" portion is widely spaced between the packed portion and the cylinder head, and a second position wherein the majority of the discs is closely packed in the space adjoining the cylinder head, while the "cooler" portion is widely spaced between the packed portion and the piston top.

Means are provided for transferring the chain of discs from one position to the second position at relatively great speed, while the piston is in, or near, either of its dead end centre positions, the discs being transferred into the respective new position gradually one by one. Assuming that the cylinder head is heated and the piston is cooled, then the temperature of each individual disc will remain substantially unchanged, as the mass of all the discs in the chain is a multiple of the mass of the gas in the cylinder, and the changing gas temperature will scarcely influence the disc temperature.

Accordingly, the temperature of the heater portion, heat-conductively attached to the cylinder head, will be slightly below the temperature of the heater fluid, and the temperature of the "cooler" portion, heat conductively attached to the piston top, will be slightly above the temperature of the cooling fluid, while the temperature of the intermediate discs, the regenerator portion, which are of low heat conductivity, will decrease gradually from the high temperature near the cylinder to the low temperature near the piston top.

The actual engine cycle is the following:

1. At the end of the expansion stroke the discs are in their "first" position, whereby the gas in the cylinder space is heated by the "heater" portion to a temperature close to the cylinder head temperature.
2. The discs are brought, one by one, at great speed to their "second" position; while they traverse the hot gas they absorb its heat energy and cool it close to the piston temperature.
3. During the compression stroke the gas remains at low temperature being cooled by the "cooler" portion, thus providing an isothermal compression.
4. At the end of the compression stroke the discs are returned to their initial "first" position, whereby the gas is heated by the heater portion.
5. The hot gas expands and drives the piston to the end of the expansion stroke, while the discs remain in their position keeping the gas at the high temperature, i.e. providing an isothermic expansion.

The chain is preferably composed of discs which are perforated in their centre and cut along a radius line; the cut portions of each two adjoining discs are connected along the radius line, whereby a spiral is formed around an empty cylindrical space. In a preferred embodiment of the engine a guide bar passes through this empty space serving to prevent the discs from contacting the cylinder wall and to keep the discs well aligned.

Another embodiment of the chain of discs comprises discs which are not cut, but are alternately connected to the adjoining discs on opposite edges, e.g. by spot welding. The chain expands in that the discs form a zigzag pattern, and contracts in that all discs are in close contact.

Various means are available and suitable for moving the discs into the required position. A preferable method comprises blowing air or gas into the cylinder space alternately in opposed axial direction, through two parallel rows of obliquely disposed openings in the cylinder wall, the air or gas hitting the edge of the discs and blowing them in the required direction. The blowing action takes place at the dead end positions of the piston and is preferably carried out by the motion of a piston reciprocating in an auxiliary cylinder the ends of which are connected to the two rows of openings in the main cylinder. The mechanism for shifting the piston is well known, as for instance for the operation of slide valves in steam engines.

Another means consists of a shaft positioned in the central perforation of the discs and provided with a sideways projecting tooth. The shaft is rapidly rotated in one sense of rotation at the end of the expansion stroke and in the opposite sense of rotation at the end of the compression stroke, whereby the tooth engages with the inner edge of the spiral formed by the discs and transports these from one end of the cylinder space to the other, from the first position into the second position.

If the discs are of a ferro-magnetic material they can be transferred from one position to the other by electromagnetic action, either by one magnet of changeable polarity, or by two magnets positioned in opposite alignment and monitored so as to shift the discs into either position.

BRIEF DESCRIPTION OF THE DRAWINGS

FIG. 3*a* is a crosssection along a line A—A shown in FIG. 3.

DETAILED DESCRIPTION OF THE PREFERRED EMBODIMENT

Figure 1:
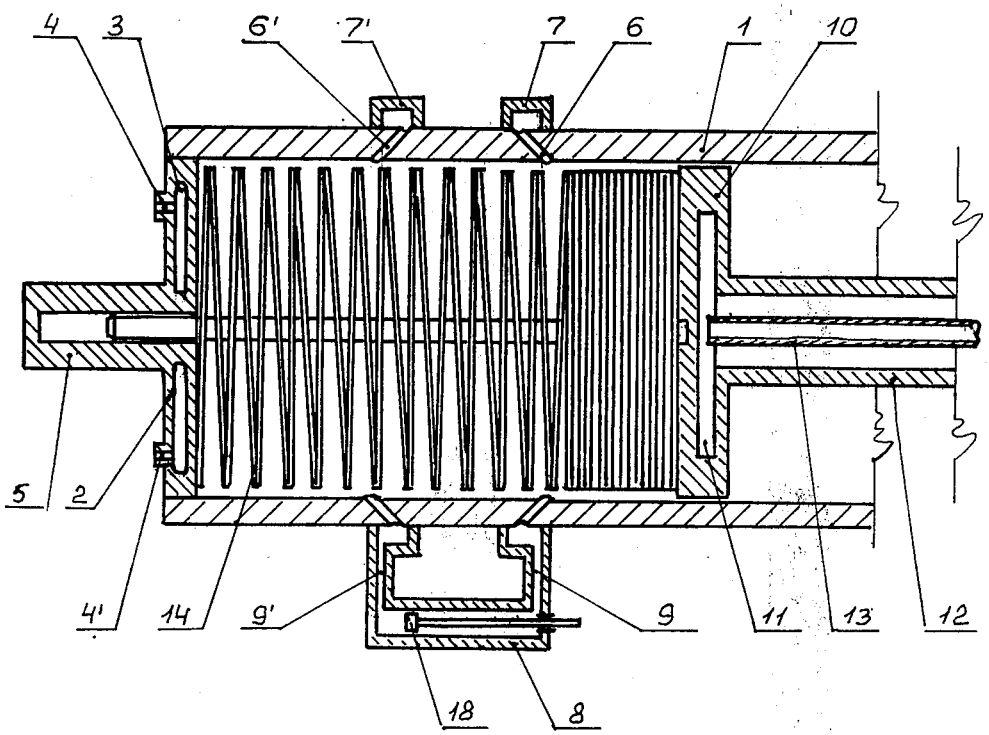
FIG. 1 illustrates, in section, a single-acting heat engine.

With reference to FIG. 1 of the drawings a heat engine comprises a cylinder 1 one end of which is closed by a cylinder head 2. The head is provided with an annular cavity 3 which communicates with the outside via two passages 4, 4'; the head is further provided with a tubular neck portion 5. The cylinder wall is perforated along two parallel circles by a plurality of obliquely directed bores 6, 6' which are surrounded, on the cylinder outside, by two circumferential channels 7, 7'. The channels are communicatingly connected via two short ducts 9, 9' to a double-acting gas compressor consisting of a cylinder 8 and a piston 18. A piston 10, provided with a circular cavity 11 is reciprocatingly movable in the cylinder 1 and connected to a crosshead (not visible) by means of a hollow piston rod 12. A straight, rigid tube 13 is concentric with the piston rod, one of its ends opening into the cavity 11 of the piston, while its other end is connected to a flexible tube attached to the crosshead, for the purpose of supplying a cooling or heating fluid to the piston. The end of the hollow piston rod is similarly connected to a second flexible tube serving as outlet for the fluid. A guide rod 14 is centrally and coaxially attached to the piston top opposite the piston rod, its free end moving in the hollow neck portion 5.

A regenerator, heater and cooler chain 15, consisting of a plurality of centrally perforated discs of a thin material extends in the space between the cylinder head 2 and the piston 10.

Adjoining discs are interconnected along a radial line, resulting in a long loose spiral, one end of which is firmly and heat-conductivley connected to the cylinder head, and the other end in a similar way to the piston top.

The discs comprise three portions, two end portions containing about 10% of all discs which are of a highly heat-conductive material, forming the heater and cooler portions, and a central portion containing about 80% of low heat conductivity, forming the regenerator.

Assuming the case that the cylinder head is kept at a high temperature by a hot fluid passing through its cavity, and that the piston is kept at a low temperature by a cold cluid passing through tubes 12 and 13 into the piston cavity, then the heater and cooler portions at the ends of the spiral are at substantially the same high and low temperatures of the cylinder head and the piston respectively. The low heat-conductive discs of the regenerator portion will decrease in temperature from a high to a low point from one end to the other.

Figure 2:
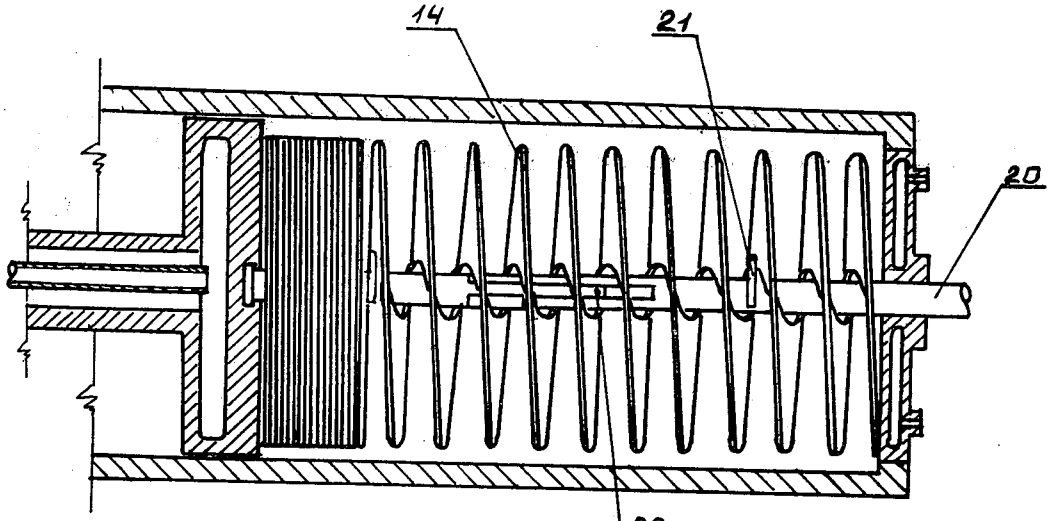
FIG. 2 illustrates, in section, a second embodiment of a single-acting heat engine.
Figure 3:
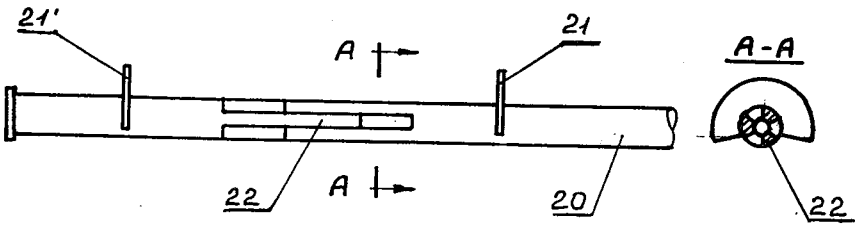
FIG. 3 illustrates a detail of the shaft of FIG. 2.

According to the engine cycle the discs are transferred from the piston side to the cylinder head side by gas alternately blown through the oblique bores 6, 6', by action of the piston 18 moving along the cylinder 8. The discs move across the cylinder space and through the gas contained therein, one by one, and either absorb heat from the gas or heat it, dependent on their direction of motion. The actual cycle is that described on pages 5, and this description is not repeated here. A second embodiment of the heat engine is illustrated in FIGS. 2 and 3 which is, in most parts, identical with that shown in FIG. 1, except for the mechanism adapted to move the discs to and fro along the cylinder space. In the present embodiment this mechanism consists of a shaft 20 provided with two sideways protruding teeth 21, 21', which is rotatable about its axis in alternate sense of rotation, and which is provided with an expansion joint 22 permitting its length to contract and to expand in accordance with the piston motion (FIG. 3). The shaft is preferably rotated by an electric motor or a turbine at high speed, which changes its direction twice during each engine cycle, where-by the teeth 21, 21' move the spiral from one end to the other, by gripping two discs simultaneously and drawing them across, one by one.

Figure 4:
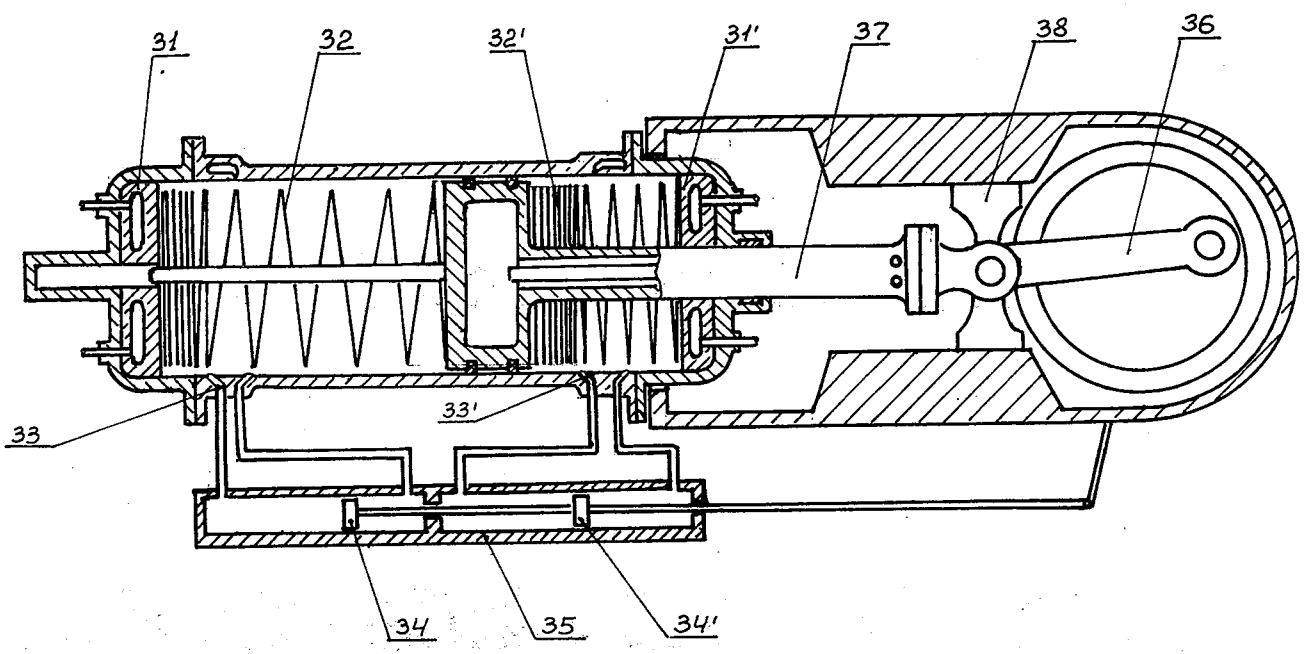
FIG. 4 illustrates, in section, a double-acting heat engine.

FIG. 4 is a section through a double-acting engine, the general construction of which is well known in respect of double-acting compressors, gas or diesel engines, even to the method of cooling the piston, and will not be explained in detail.

The outstanding features of this engine are: Two heater bodies 31, 31' provided in the two cylinder ends, each connected to a heat source; secondly two disc chains 32, 32' in the respective cylinder spaces, firmly and heat-conductively connected to the piston and the heater bodies; they are alternately motioned to the front and the rear of the respective cylinder space by the gas blowing means described in respect of FIG. 1. The gas flow is alternately directed through obliquely directed bores 33, 33' by movement of two pistons 34, 34' in a divided cylinder 35 in a similar manner as beforedescribed.

It will be understood that the gas in the two cylinder spaces is alternately compressed and expanded, driving a crank 36 via a piston rod 37 and a cross head 38.

In the foregoing description it was assumed that the cylinder heads are heated and that the piston is cooled, but it will be understood that the same heat cycle can be obtained while reversing this scheme, i.e. cooling the cylinder and heating the piston. Although it is not shown in the drawings, it is understood that the cylinder outside is well heat-insulated to prevent heat losses and to improve the engine efficiency.

As indicated before, the process may be reversed, and by supplying mechanical energy to the engine this may be utilized as a refrigerating unit.

The aforedescribed embodiments represent only a part of the possible constructions of a heat engine of this kind, and many modifications may be carried out to these by a person skilled in the art, without however departing from the spirit of the invention and the scope of the appended claims.

The chain should contain between 100 to 600 discs of 0.05 to 0.1 mm thickness. A compression ratio of 2:1 to 3:1 has given satisfactory results, especially when utilizing solar energy.

It is proposed, in order to increase the heat transfer between gas and discs, to create turbulent gas movement by providing in the cylinder wall, so-called air cells which are well known in connection with compression-ignition engines for the purpose of obtaining a swirl motion of gas and fuel.

I claim:

1. A closed-cycle heat engine comprising a gas-filled cylinder and a piston reciprocating therein, wherein the cylinder walls are heat-insulated and the cylinder head is permenently heated by a fluid in contact with a heat source, and wherein the piston is permanently cooled by a fluid in contact with a heat sink, the heat engine being characterized by that the cylinder space between the cylinder head and the piston contains an expansible and contractible chain of a plurality of interconnected, parallel-positioned flat discs of a thin sheet material of a diameter slightly smaller than the cylinder diameter, whereof the outermost disc at each end is firmly and heat-conductively connected to the piston and to the cylinder head respectively, the discs of the two end portions of the chain being of a highly heat conducting material with flat and smooth surfaces serving as "cooler" and "heater" portions respectively, while the discs in the central portion are of low heat conductivity serving as "regenerator" portion, means being provided for gradually shifting the discs of the chain from a first position of closely packed discs of the cooler and regenerator portions adjacent the piston to a second position of closely packed discs of the heater and regenerator portions adjacent the cylinder head, this shifting being carried out at the end of the expansion stroke, and similar means being provided for returning the discs from the second position into the first position at the end of the compression stroke.

2. The heat engine of claim 1 provided with a cavity in the cylinder head adapted for the through-flow of a fluid.

3. The heat engine of claim 1, provided with a cavity in the piston adapted for a through-flow of a fluid.

4. The heat engine of claim 1 of double-acting construction, having two gas-filled spaces between one piston and two cylinder heads.

5. The heat engine of claim 1 comprising a chain of discs, wherein each disc is perforated in its centre, is cut along a radial line and is connected to the disc adjacent to it along the cut, thus forming a spiral-shaped chain.

6. The heat engine of claim 1, wherein the cylinder wall is perforated by two rows of obliquely directed bores arranged on two parallel circumferential circles of the cylinder, and wherein means are provided for blowing gas alternately through these bores.

7. The heat engine of claim 5, wherein the discs are guided by a cylindrical bar fastened to the centre of the piston and passing through the central perforation of all discs of the chain.

8. The heat engine of claim 5, wherein the discs are shifted from a first position into a second position by a rotating shaft positioned in the cylinder space and provided with at least one lateral tooth engaging with the inner edge of the spiral, the shaft being rotated in forward and backward direction at the end of the compression stroke and the expansion stroke respectively.

9. The heat engine of claim 1, wherein the "heater" and the "cooler" portions consist each of 10% of the total number of discs, the remaining 80% forming the "regenerator" portion.

10. A closed-cycle heat engine comprising a gas-filled cylinder and a piston reciprocating therein, wherein the cylinder walls are heat-insulated and the cylinder head-iis permanently cooled by a fluid in contact with a heat sink, and wherein the piston is permanently heated by a fluid in contact with a heat source, the heat engine being characterized by that the cylinder space between the piston and the cylinder head contains an expansible and contractible chain of a plurality of interconnected, parallel-positioned flat discs of a thin sheet material of a diameter slightly smaller than the cylinder diameter, whereof the outermost disc at each end is firmly and heat-conductively connected to the piston and to the cylinder head respectively, the discs of the two end portions of the chain being of a highly heat conducting material with flat and smooth surfaces serving as "heater" and "cooler" portions respectively, while the discs in the central portion are of low heat conductivity serving as "regenerator" portion, means being provided for gradually shifting the discs of the chain from a first position of closely packed discs of the heater and regenerator portions adjacent the piston to a second position of closely packed discs of the cooler and regenerator portions adjacent the cylinder head, this shifting being carried out at the end of the expansion stroke, and similar means being provided for returning the discs from the second position into the first position at the end of the compression stroke.

11. The heat engine of claim 10 provided with a cavity in the cylinder head adapted for the through-flow of a fluid.

12. The heat engine of claim 10, provided with a cavity in the piston for a through-flow of a fluid.

13. The heat engine of claim 10 of double-acting construction, having two gas-filled spaces between one piston and two cylinder heads.

14. The heat engine of claim 10 comprising a chain of discs, wherein each disc is perforated in its centre is cut along a radial line and is connected to the disc adjacent to it along the cut, thus forming a spiral-shaped chain.

15. The heat engine of claim 10, wherein the cylinder wall is perforated by two rows of obliquely directed bores arranged on two parallel circumferential circles of the cylinder, and wherein means are provided for blowing gas alternately through these bores.

16. The heat engine of claim 10, wherein the "heater" and the "cooler" portions consist of 10% of the total number of discs, the remaining 80% forming the "regenerator" portion.

17. The heat engine of claim 14, wherein the discs are guided by a cylindrical bar fastened to the centre of the piston and passing through the central performation of all discs of the chain.

18. The heat engine of claim 14, wherein the discs are shifted from a first position into a second position by a rotating shaft positioned in the cylinder space and provided with at least one lateral tooth engaging with the inner edge of the spiral, the shaft being rotated in forward and backward direction at the end of the compression stroke and the expansion stroke respectively.

* * * * *